US010749301B2

(12) United States Patent
Matsui et al.

(10) Patent No.: US 10,749,301 B2
(45) Date of Patent: Aug. 18, 2020

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/475,425

(22) PCT Filed: Dec. 18, 2017

(86) PCT No.: PCT/JP2017/045258
§ 371 (c)(1),
(2) Date: Jul. 2, 2019

(87) PCT Pub. No.: WO2018/128069
PCT Pub. Date: Jul. 12, 2018

(65) Prior Publication Data

US 2019/0334301 A1 Oct. 31, 2019

(30) Foreign Application Priority Data

Jan. 6, 2017 (JP) ..... 2017-001077

(51) Int. Cl.
*H01R 25/00* (2006.01)
*H01R 13/424* (2006.01)
*H01R 13/506* (2006.01)

(52) U.S. Cl.
CPC ..... *H01R 25/003* (2013.01); *H01R 13/424* (2013.01); *H01R 13/506* (2013.01)

(58) Field of Classification Search
CPC ..... H01R 25/003; H01R 13/424; H01R 13/13506
(Continued)

(56) References Cited

U.S. PATENT DOCUMENTS 3,208,028 A 9/1965 Mittler
3,701,964 A 10/1972 Cronin
(Continued)

FOREIGN PATENT DOCUMENTS

JP 05-114315 5/1993
JP 2003-059598 2/2003
(Continued)

OTHER PUBLICATIONS

International Search Report dated Jan. 23, 2018.

*Primary Examiner* — Alexander Gilman
(74) *Attorney, Agent, or Firm* — Gerald E. Hespos; Michael J. Porco; Matthew T. Hespos

(57) ABSTRACT

It is aimed to enable conductive paths in a narrow and bent space. A connector (A) includes a terminal fitting (37F, 37S, 37T) having a terminal base portion (38) and three tabs (39F, 39D, 39R) extending from the terminal base portion (38) in mutually different directions, and a housing (10) having a body portion (11) for accommodating the terminal base portion (38) and three receptacles (12F, 12D, 12R) for individually surrounding the three tabs (39F, 39D, 39R). If end parts of three conductive paths (61F, 61D, 61R) are connected to the three tabs (39F, 39D, 39R), a main line (52M) is constituted by two tabs (39F, 39R) and two conductive paths (61F, 61R) and a branch line (52S) is constituted by one tab (39D) and one conductive path (61D).

16 Claims, 19 Drawing Sheets

(58) Field of Classification Search
USPC ..... 439/509
See application file for complete search history.

(56) References Cited

U.S. PATENT DOCUMENTS 4,037,912 A * 7/1977 Besser ..... H01R 31/02 439/724
4,174,878 A * 11/1979 Debaigt ..... H01R 13/115 439/752
4,399,371 A * 8/1983 Ziff ..... H02G 3/00 307/147
4,487,464 A * 12/1984 Kirschenbaum ..... H01R 31/085 439/507
4,556,274 A * 12/1985 Olivera ..... H01H 85/2035 439/620.34
5,000,699 A * 3/1991 Nadin ..... H01R 31/08 439/189
5,007,888 A * 4/1991 Goutiere ..... H01R 31/02 439/189
5,073,120 A * 12/1991 Lincoln ..... H01R 31/02 439/215
5,106,318 A * 4/1992 Endo ..... H01R 31/08 439/189
5,414,587 A 5/1995 Kiser
5,474,475 A * 12/1995 Yamaguchi ..... H01H 85/2035 439/620.27
5,503,565 A * 4/1996 McCoy ..... H01R 29/00 439/171
5,645,455 A * 7/1997 Seki ..... H01R 13/405 439/189
5,908,322 A * 6/1999 Seki ..... H01R 9/2458 439/212
6,739,920 B2 * 5/2004 Fujii ..... H01R 31/085 439/723
7,867,001 B2 * 1/2011 Ambo ..... H01R 4/185 439/271
8,817,576 B2 * 8/2014 Tsuzuki ..... G10K 11/004 367/121
9,112,293 B2 * 8/2015 Suzuki ..... H01R 13/4223
9,531,104 B1 * 12/2016 Park ..... H01R 13/4361
9,698,550 B2 * 7/2017 Byrne ..... H01R 31/02
2003/0040224 A1 2/2003 Fujii et al.

FOREIGN PATENT DOCUMENTS

JP 2004-311223 11/2004
JP 2005-038737 2/2005
JP 5330925 10/2013

* cited by examiner

CONNECTOR

BACKGROUND

Field of the Invention

The invention relates to a connector.

Description of the Related Art

Japanese Unexamined Patent Publication No. H05-114315 discloses a technique for bending wires into a branched state and holding a bent part of the wires by winding an adhesive tape in a conductive path (wiring harness) formed by bundling a plurality of wires. The technique for fixing the bent part of the wires by the adhesive tape also is used for splicing two wires and bending and branching one wire.

A core of a wire is made of metal and has a high flexural rigidity, and a wire that is bent forcibly at a small radius of curvature may be broken. Thus, it is difficult to bend the wire at a small radius of curvature and it is unavoidable that a bent part of the wire bulges. Particularly, as more wires are bent, a radius of curvature increases and a volume of a bent part increases. If the bent part is bulging, it is difficult to route conductive paths in a narrow and bent space, such as the inside of a pillar of a body of an automotive vehicle.

The invention was completed on the basis of the above situation and aims to enable conductive paths to be routed in a narrow and bent space.

SUMMARY

The invention is directed to a connector with a terminal fitting including a terminal base and three tabs extending from the terminal base in different directions. The connector also has a housing including a body for accommodating the terminal base and three receptacles for individually surrounding the three tabs.

End parts of three conductive paths may be connected to the three tabs. Thus, a main line is constituted by two tabs and two conductive paths, and a branch line is constituted by one tab and one conductive path. A part where the branch line is branched from the main line is constituted by terminal base of the terminal fitting and base end parts of the tabs. If the base ends of the tabs are shaped linearly, a radius of curvature of a branched part of the main line and the branch line can be made smaller. Thus, the conductive paths can be routed in a narrow and bent space.

Positioning holes for positioning the tabs may be formed in three separation wall portions partitioning between the body and the three receptacles. According to this configuration, one terminal fitting can be positioned stably by three positioning holes.

The housing may be formed by uniting divided bodies each formed by integrating an accommodating portion of the body and one of the receptacles. According to this configuration, the terminal base can be accommodated in the body by uniting the accommodating portions.

A temporary holding member may be formed with holding grooves in an upper surface and vertically penetrating through holes. The three tabs may extend forward, rearward and downward from the terminal base. A plurality of the terminal fittings may be mounted in the temporary holding member with the terminal bases mounted in the holding grooves and the downward extending tabs penetrating through the through holes. According to this configuration, the terminal fittings can be positioned and held temporarily by one temporary holding member.

The temporary holding members may be assembled while being vertically laminated. According to this configuration, the forward extending tabs can be arranged vertically side by side and the rearward extending tabs can be arranged vertically side by side.

The vertically laminated temporary holding members may be shaped identically and may include fittings to be fit to obtain such a positional relationship that the temporary holding members are displaced from each other in a front-rear direction in a laminated state. According to this configuration, the downward extending tabs can be arranged side by side in a front-rear direction without interfering with each other.

An extending dimension of the downward extending tab from the terminal base may be longer for the terminal fitting mounted in the temporary holding member on an upper side than for the terminal fitting mounted in the temporary holding member on a lower side. According to this configuration, the heights of the lower ends of the downward extending tabs can be aligned.

An extending dimension of the forward extending tab from the terminal base may be longer for the terminal fitting mounted in the temporary holding member on a rear side than for the terminal fitting mounted in the temporary holding member on a front side. According to this configuration, the positions of the extending ends of the forward extending tabs can be aligned.

An extending dimension of the rearward extending tab from the terminal base may be longer for the terminal fitting mounted in the temporary holding member on a front side than for the terminal fitting mounted in the temporary holding member on a rear side. According to this configuration, the positions of the extending ends of the rearward extending tabs can be aligned.

The terminal fittings may be mounted in one housing, and the housing may be provided with a short-circuit member for shorting the terminal fittings to each other by contacting the tabs.

The short-circuit member may include conduction holes for allowing the tabs to pass therethrough in a contact state and non-contact holes for allowing the tabs to pass therethrough in a non-contact state. According to this configuration, only desired terminal fittings can be shorted by appropriately setting an arrangement of the conductive holes and the non-contact holes.

DETAILED DESCRIPTION

Figure 3:
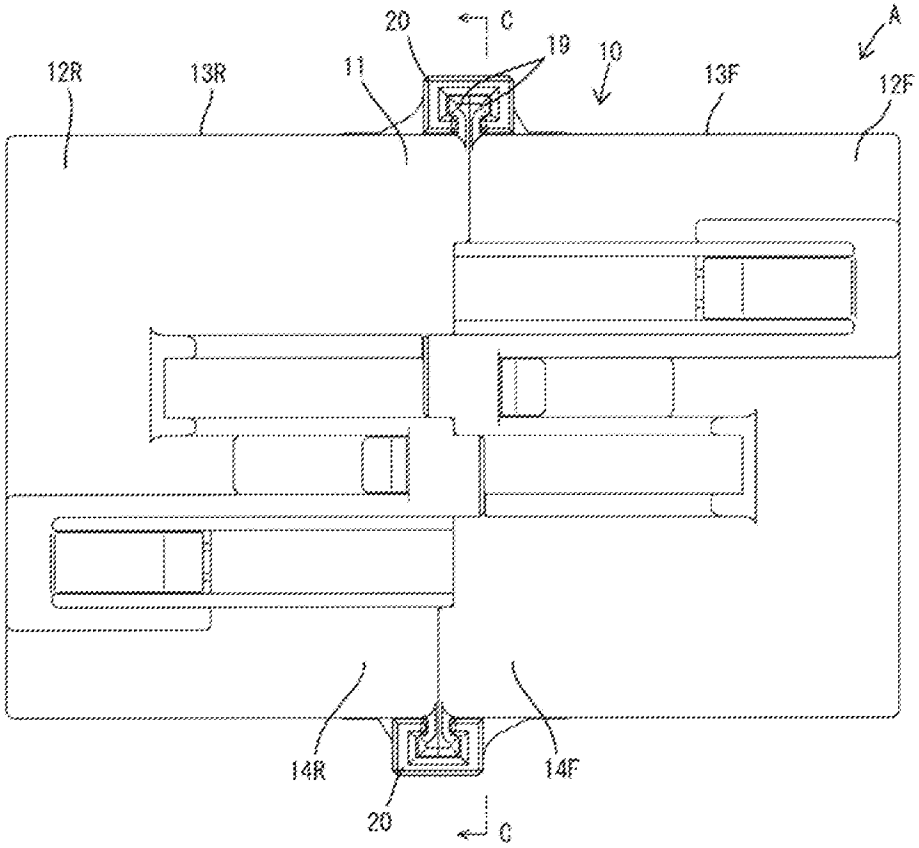
FIG. 3 is a plan view of the connector.
Figure 4:
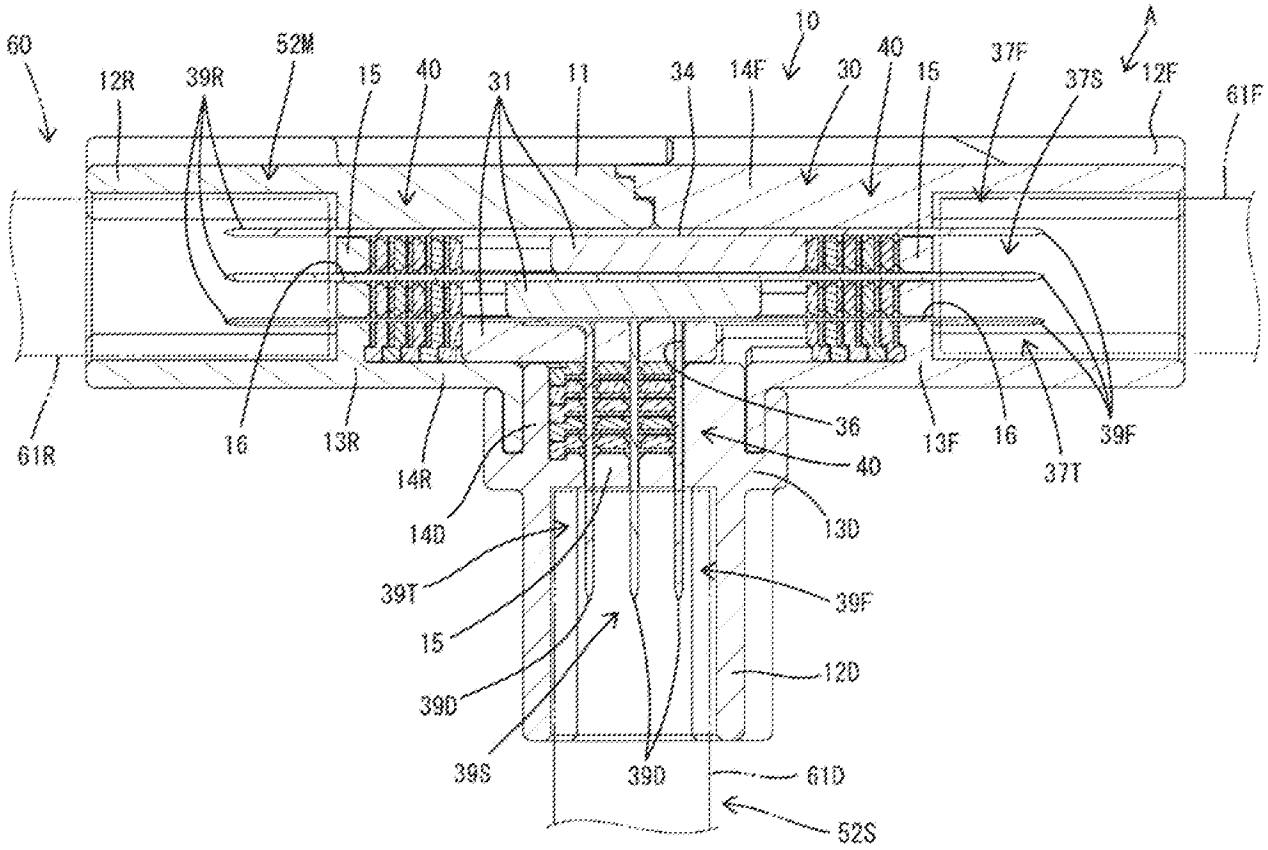
FIG. 4 is a section along A-A of FIG. 2.
Figure 5:
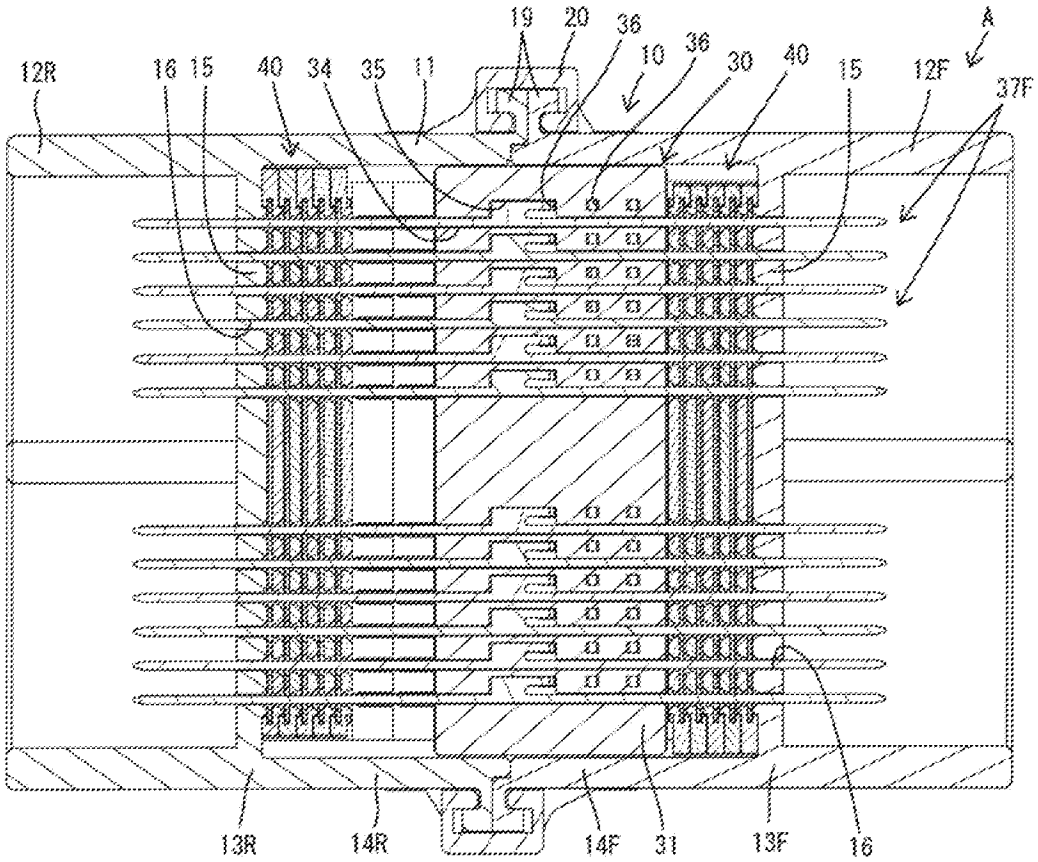
FIG. 5 is a section along B-B of FIG. 2.

An embodiment of the invention is described with reference to FIGS. 1 to 9. Note that, in the following description, a right side in FIGS. 3 to 5 is defined as a front concerning a front-rear direction. Upper and lower sides shown in FIGS. 1, 2, 4 and 6 to 19 are defined as upper and lower sides concerning a vertical direction.

A connector A of this embodiment is used in the case of routing a wiring harness 60 in a narrow and bent space such as the inside of a pillar of a body of an automotive vehicle and has a function of relaying and branching conductive paths 61F, 61D and 61R of the wiring harness 60. The connector A includes a housing 10 made of synthetic resin, one terminal module 30 provided in the housing 10 and three short-circuit modules 40 provided in the housing 10.

<Housing 10>

Figure 7:
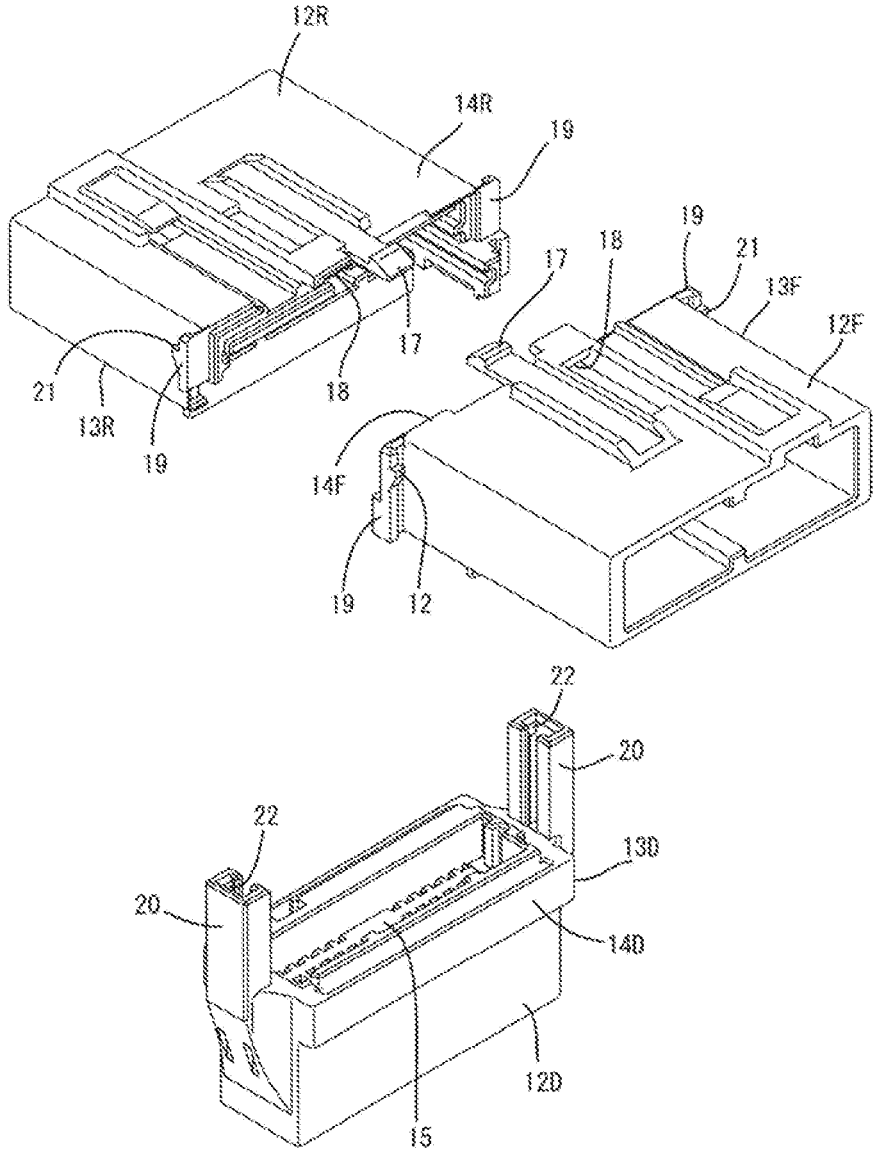
FIG. 7 is a perspective view showing a state where a housing is divided into three divided bodies.

The housing 10 includes a box-shaped body 11 whose interior serves as an accommodation space, a forward facing receptacle 12F in the form of a rectangular tube, a rearward facing receptacle 12R in the form of a rectangular tube and a downward facing receptacle 12D in the form of a rectangular tube. The receptacles 12F, 12R and 12D project from the body 11, and the housing 10 is substantially T-shaped in a side view. The housing 10 has a rectangular planar shape long in the front-rear direction. As shown in FIG. 7, the housing 10 is configured by uniting a front divided body 13F, a rear divided body 13R and a lower divided body 13D.

The front divided body 13F is a single component with a front accommodating portion 14F in the form of a rectangular tube extending rearward from the rear end of the forward facing receptacle 12F and a separation wall 15 partitioning between the rear end of the forward facing receptacle 12F and the front end of the front accommodating portion 14F. The rear divided body 13R is a single component with a rear accommodating portion 14R in the form of a rectangular tube extending forward from the front end of the rearward facing receptacle 12F and a separation wall 15 partitioning between the front end of the rearward facing receptacle 12F and the rear end of the rear accommodating portion 14R.

The lower divided body 13D is a single component with a lower accommodating portion 14D in the form of a rectangular tube extending down from the upper end of the downward facing receptacle 12D and a separation wall 15 partitioning between the upper end of the downward facing receptacle 12D and the lower end of the lower accommodating portion 14D. The separation walls 15 of the front divided body 13F and the rear divided body 13R are formed with positioning holes 16 penetrating in the front-rear direction, and the separation wall 15 of the lower divided body 13D is formed with positioning holes 16 penetrating in the vertical direction.

Figure 1:
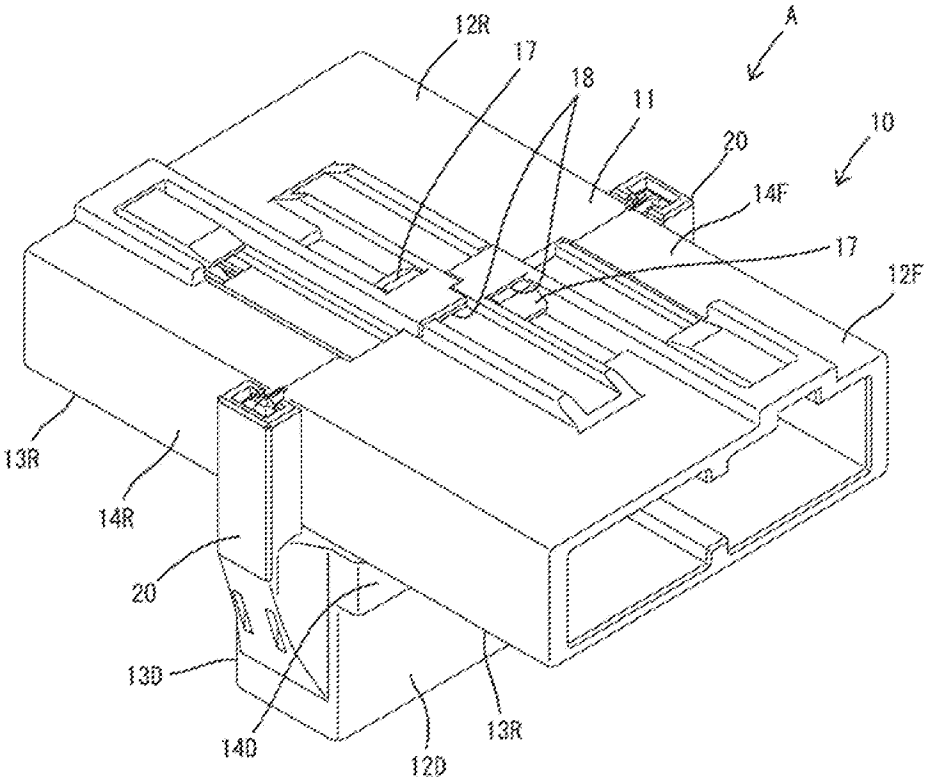
FIG. 1 is a perspective view of a connector of one embodiment.
Figure 2:
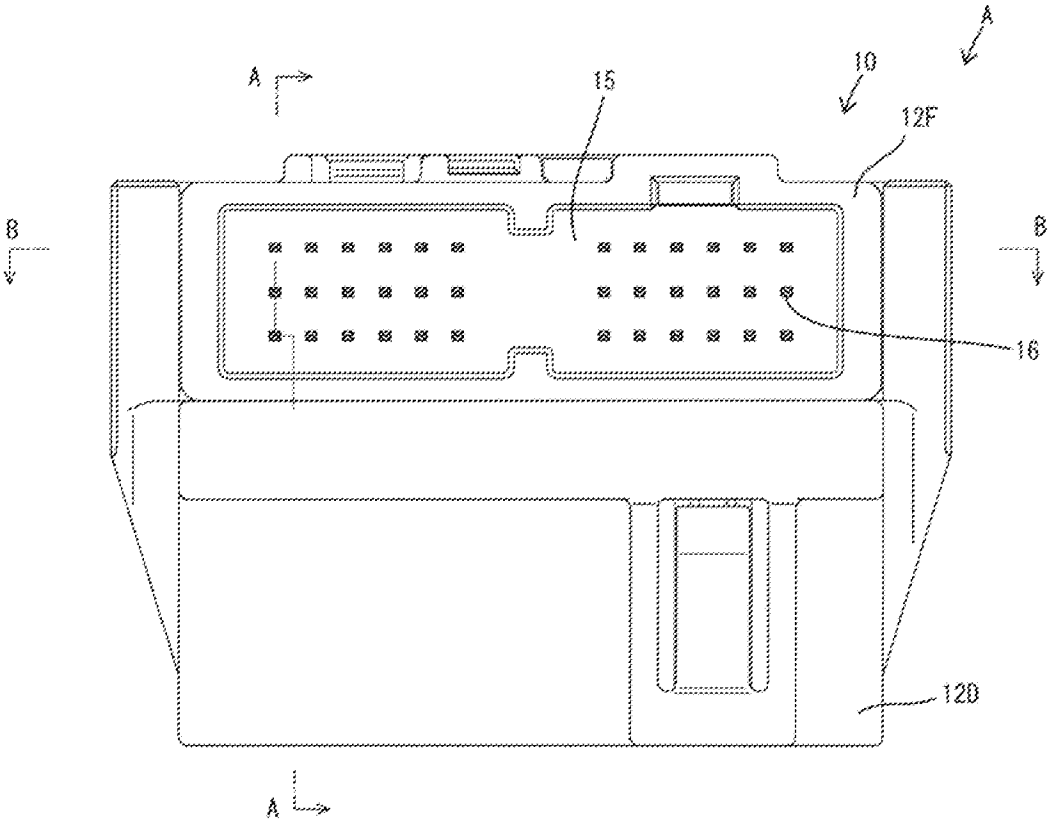
FIG. 2 is a front view of the connector.

As shown in FIG. 1, the front divided body 13F and the rear divided body 13R are held united adjacent to each other in the front-rear direction by respectively locking a lock arm 17 and a lock hole 18 on the rear edge of the upper surface of the front divided body 13F and a lock hole 18 and a lock arm 17 formed on the front edge of the upper surface of the rear divided body 13R. Left and right coupling ribs 19 formed on an opening edge of the rear surface of the front divided body 13F and left and right coupling ribs 19 formed on an opening edge of the front surface of the rear divided body 13R are united in the front-rear direction.

The lower divided body 13D is formed with two groove-shaped arms 20 projecting up from both left and right ends of an opening edge of the upper surface thereof. When the lower divided body 13D is assembled with the front and rear divided bodies 13F, 13R from below, the left and right coupling ribs 19 are fit into the left and right groove-shaped arms 20 and, as shown in FIG. 7, lock projections 21 of the coupling ribs 19 are locked to lock receiving portions 22 of the groove-shaped arms 20. Thus, the three divided bodies 13F, 13D and 13R are locked together. With the three divided bodies 13F, 13D and 13R united, the body portion 11 is constituted by the front accommodating portion 14F, the rear accommodating portion 14R and the lower accommodating portion 14D and an accommodation space T-shaped in a side view is formed in the body 11.

<Terminal Module 30>

Figure 8:
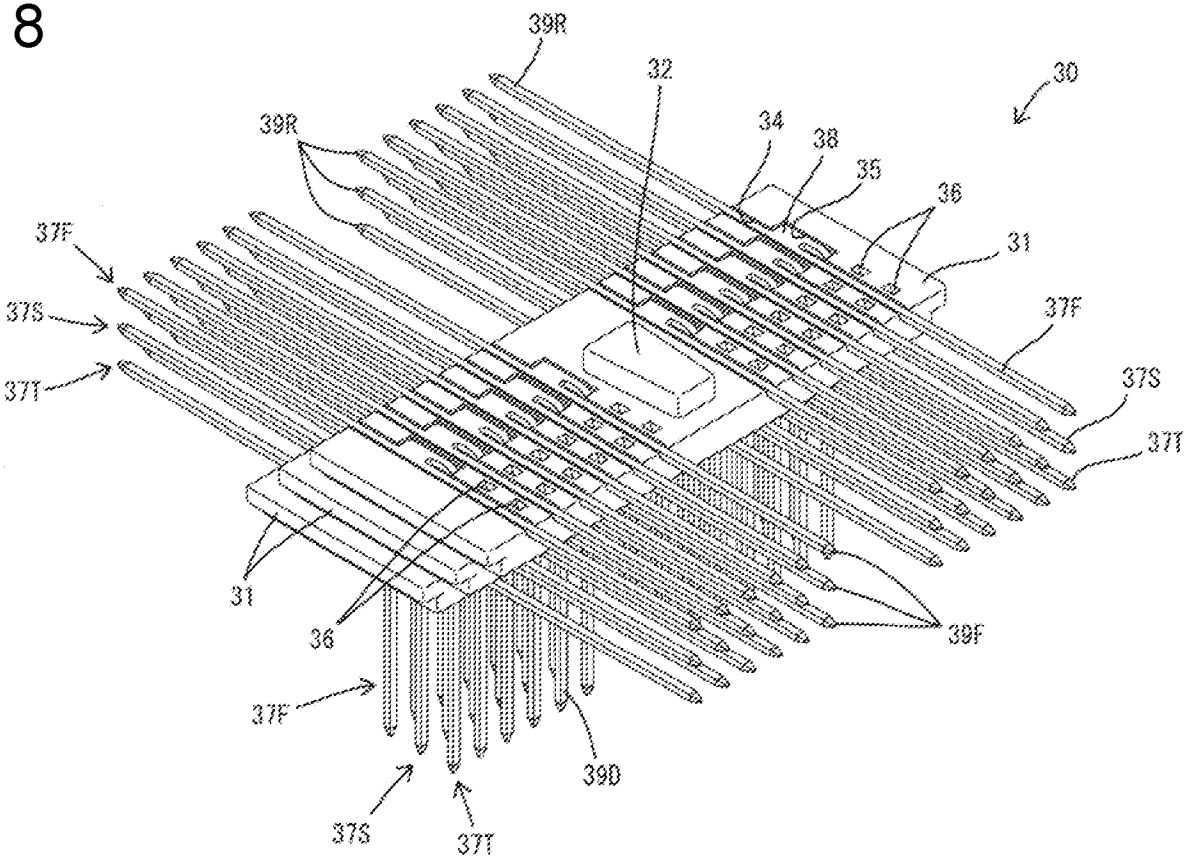
FIG. 8 is a perspective view of a terminal module configured by temporarily holding a plurality of terminal fittings by three temporary holding members.
Figure 9:
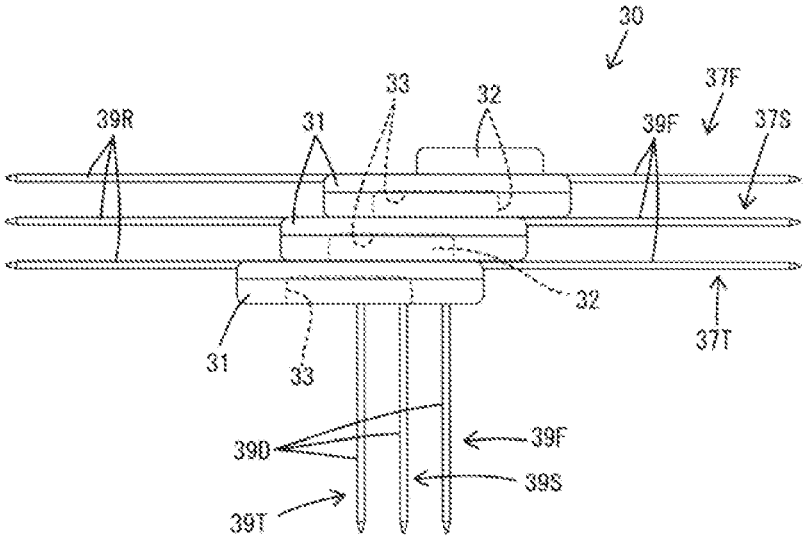
FIG. 9 is a side view of the terminal module.
Figure 10:
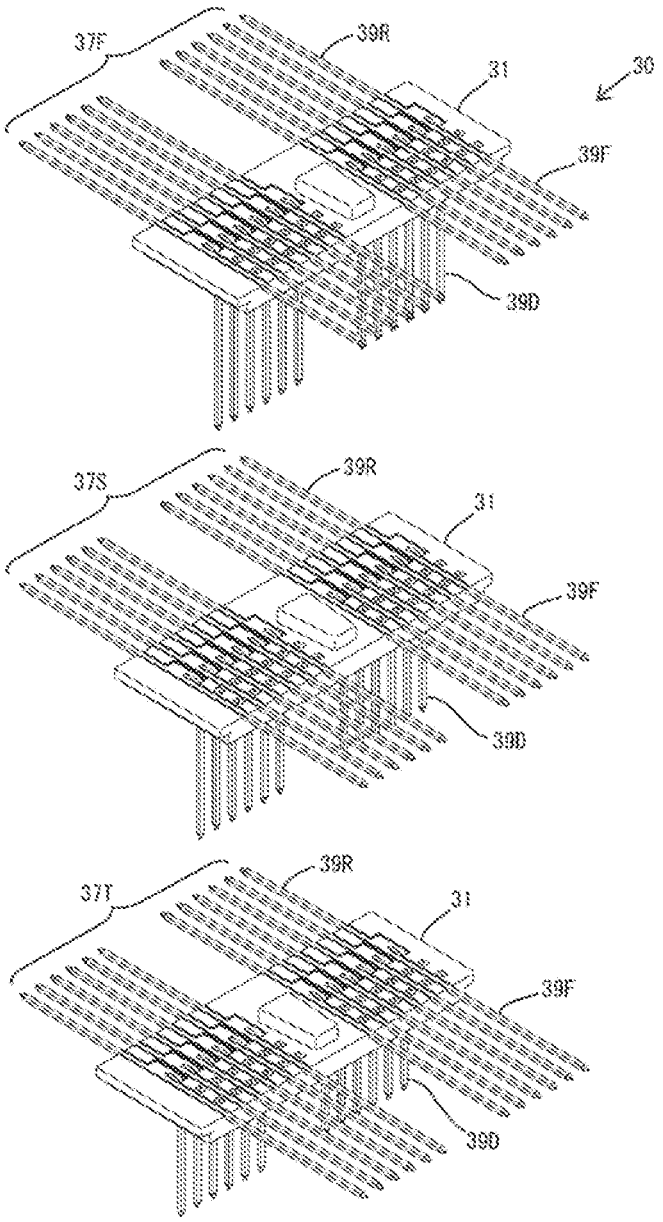
FIG. 10 is a perspective view showing a state where the terminal module is divided into three.

As shown in FIGS. 8 to 10, the terminal module 30 is composed of three temporary holding members 31, a plurality of first terminal fittings 37F, a plurality of second terminal fittings 37S and a plurality of third terminal fittings 37T.

Figure 11:
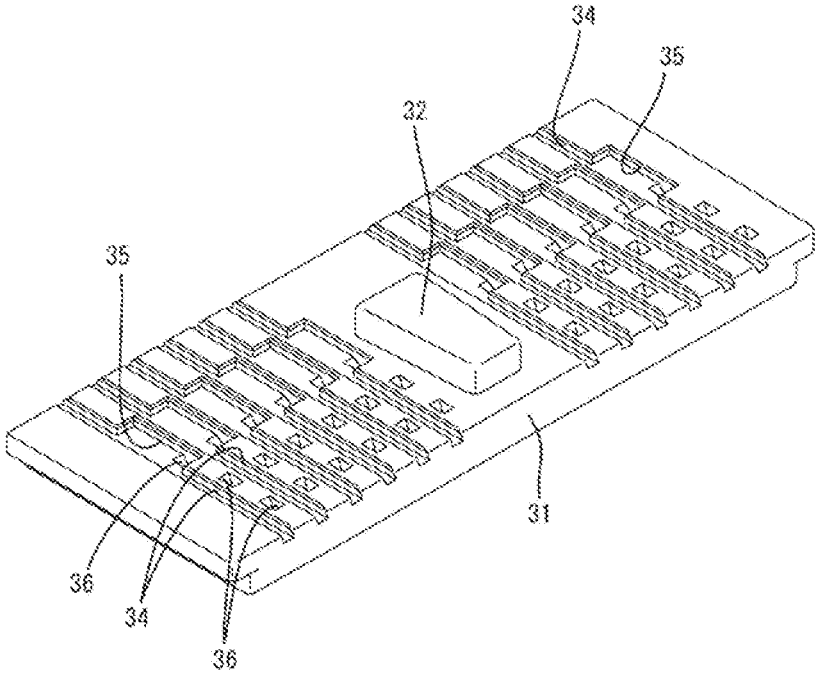
FIG. 11 is a perspective view of the temporary holding member.

The three temporary holding members 31 have the same shape and dimensions. As shown in FIG. 11, the temporary holding member 31 is a substantially rectangular plate longer in a lateral direction in a plan view. A fitting projection 32 (fitting portion as claimed) is in a laterally central part of the upper surface of the temporary holding member 31. A fitting recess 33 (fitting portion as claimed) is formed in a laterally central part of the lower surface of the temporary holding member 31. As shown in FIG. 9, the fitting recess 33 is at a position deviated rearward from the fitting projection 32.

The three temporary holding members 31 are assembled to be laminated one over another. In an assembled state, two temporary holding members 31 are positioned in the front-rear direction and the lateral direction by fitting the fitting recess 33 of the temporary holding member 31 on an upper side and the fitting projection 32 of the temporary holding member 31 on a lower side. Since the fitting projections 32 are located in front of the fitting recesses 33, the uppermost temporary holding member 31 is on a foremost side and the lowermost temporary holding member 31 is located on a rearmost side.

Holding grooves 34 are formed laterally side by side in regions to the right of and to the left of the fitting projection 32 on the upper surface of the temporary holding member 31 and are elongated in the front-rear direction. A part of each holding groove 34 slightly behind a center in the front-rear direction serves as a wide portion 35 having a width enlarged in one lateral direction. Through holes 36 vertically penetrate through the temporary holding member 31. Three through holes 36 arranged in the front-rear direction are disposed to correspond to each holding groove 34. The through hole 36 on a rear end is located in a front part of the wide portion 35. The through holes 36 on a front end and in a center are adjacent to a region of the holding groove 34 in front of the wide portion 35.

Each terminal fitting 37F, 37S, 37T is a single component processed by bending a metal plate material and composed of a terminal base 38, a forward facing tab 39F extending straight forward from the front end of the terminal base 38, a rearward facing tab 39R extending straight rearward from the rear end of the terminal base 38 and a downward facing tab 39D extending straight down from the terminal base 38. The terminal base 38, the forward facing tab 39F and the rearward facing tab 39R are connected linearly in the front-rear direction. The downward facing tab 39D extends at a right angle to both front and rear tabs 39F, 39R from a position of the front end of the terminal base 38 laterally deviated from a base of the forward facing tab 39F (rear end connected to the terminal base 38).

The terminal fittings 37F, 37S and 37T are held temporarily while being positioned in the front-rear direction and the lateral direction. In the temporarily held state, the downward facing tabs 39D are inserted through the through holes 36 of the wide portions 35, the terminal bases 38 are fit into the wide portions 35 of the holding grooves 34, and the bases of the forward facing tabs 39F and bases (front end parts) of the rearward facing tabs 39R are fit into the holding grooves 34. The temporary holding members 31 and the terminal fittings 37F, 37S and 37T are not provided with any means for separating the terminal fittings 37F, 37S and 37T upward from the temporary holding members 31.

As shown in FIG. 10, the first terminal fittings 37F are held temporarily in the uppermost temporary holding member 31, the second terminal fittings 37S are held temporarily in the middle temporary holding member 31 and the third terminal fittings 37T are held temporarily in the lowermost temporary holding member 31. The downward facing tabs 39D of the first terminal fittings 37F are inserted not only through the through holes 36 of the uppermost temporary holding member 31, but also through the through holes 36 of the middle temporary holding member 31 and the through holes 36 of the lowermost temporary holding member 31. The downward facing tabs 39D of the second terminal fittings 37S are inserted not only through the through holes 36 of the middle temporary holding member 31, but also through the through holes 36 of the lowermost temporary holding member 31.

Figure 12:
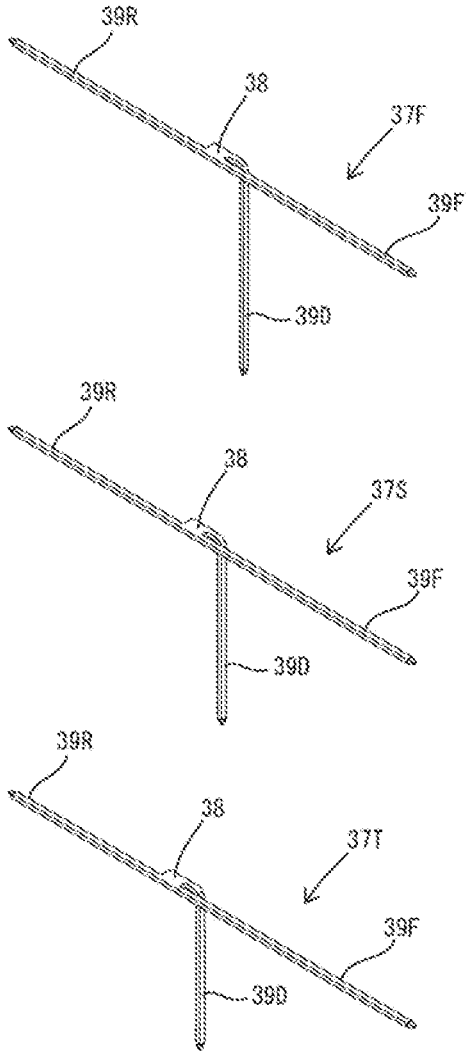
FIG. 12 is a perspective view showing a state where three types of terminal fittings are arranged in a separated manner.

With the three temporary holding members 31 having the terminal fittings 37F, 37S and the 37T temporarily held therein laminated, a projecting dimension of the forward facing tabs 39F from the terminal bases 38 is set to be shortest for the first terminal fittings 37F and longest for the third terminal fittings 37T, as shown in FIG. 12, in view of the fact that the uppermost temporary holding member 31 is located on the foremost side and the lowermost temporary holding member 31 is located on the rearmost side. By this dimensioning, the positions of the front ends of the forward facing tabs 39F of all the terminal fittings 37F, 37S and 37T are aligned in the front-rear direction, as shown in FIGS. 4, 5 and 9.

Figure 6:
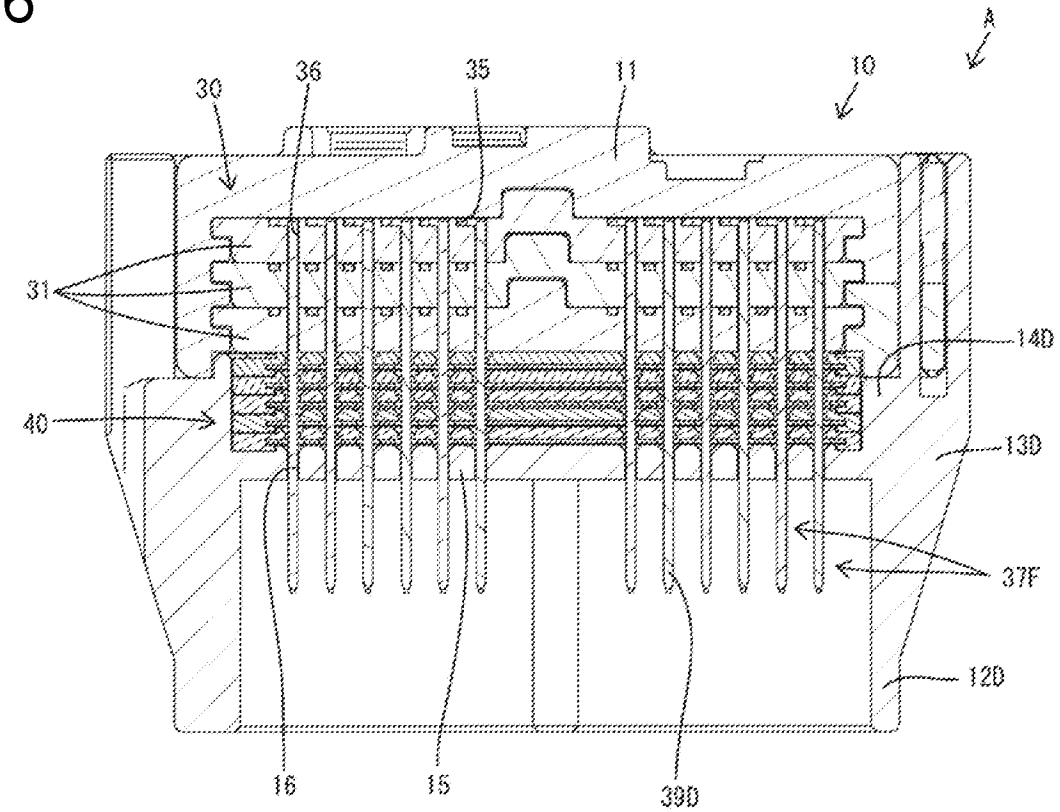
FIG. 6 is a section along C-C of FIG. 3.

Further, a projecting dimension of the rearward facing tabs 39R from the terminal bases 38 is longest for the first terminal fittings 37F and shortest for the third terminal fittings 37T. By this dimensioning, the positions of the rear ends of all the rearward facing tabs 39R of all the terminal fittings 37F, 37S and 37T are aligned in the front-rear direction, as shown in FIGS. 4, 5 and 9. Further, a projecting dimension of the downward facing tabs 39D from the terminal bases 38 is longest for the first terminal fittings 37F and shortest for the third terminal fittings 37T. By this dimensioning, the positions of the lower ends of all the downward facing tabs 39D of all the terminal fittings 37F, 37S and 37T are aligned in the vertical direction, as shown in FIGS. 4 and 6.

<Short-Circuit Module 40>

Figure 13:
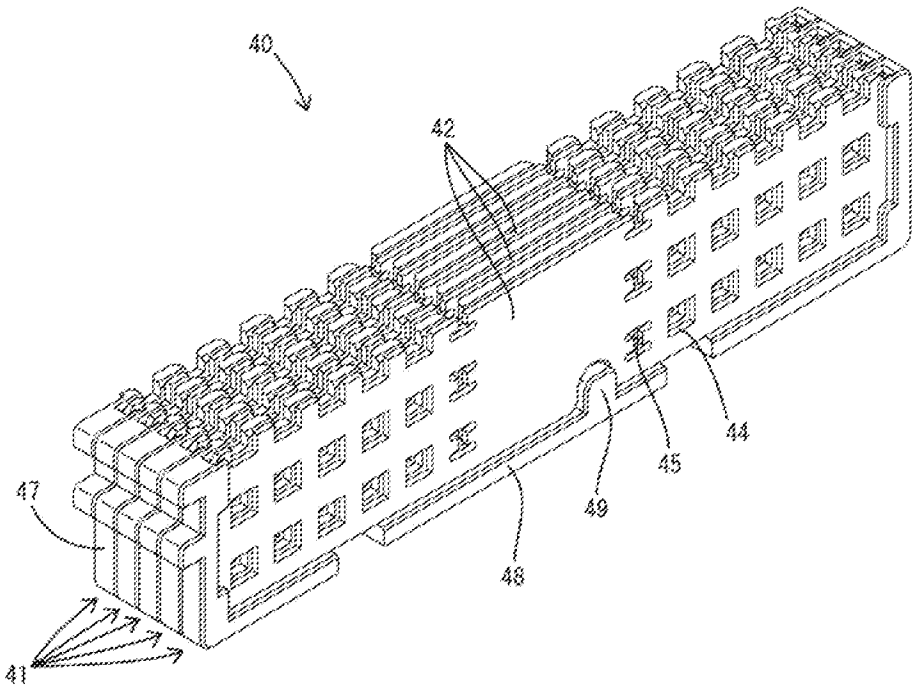
FIG. 13 is a perspective view of a short-circuit module.
Figure 14:
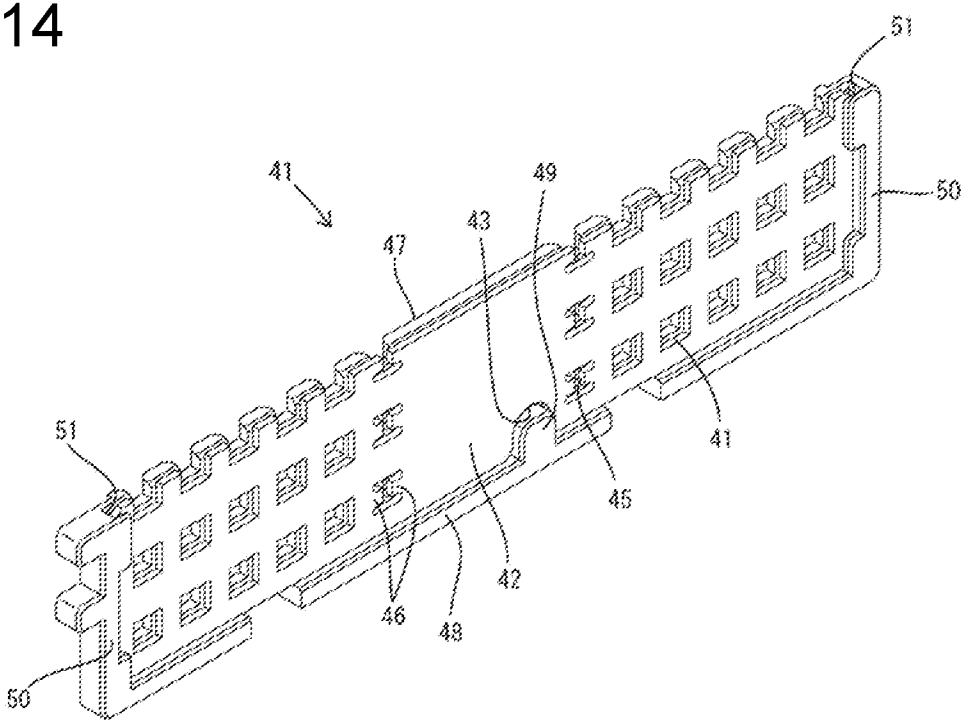
FIG. 14 is a perspective view of a short-circuit unit.
Figure 15:
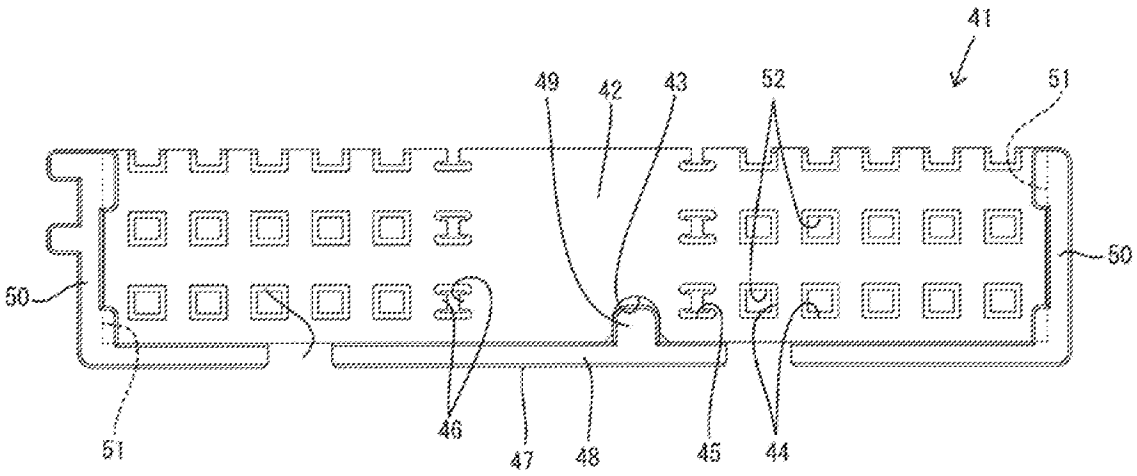
FIG. 15 is a front view of the short-circuit unit.
Figure 16:
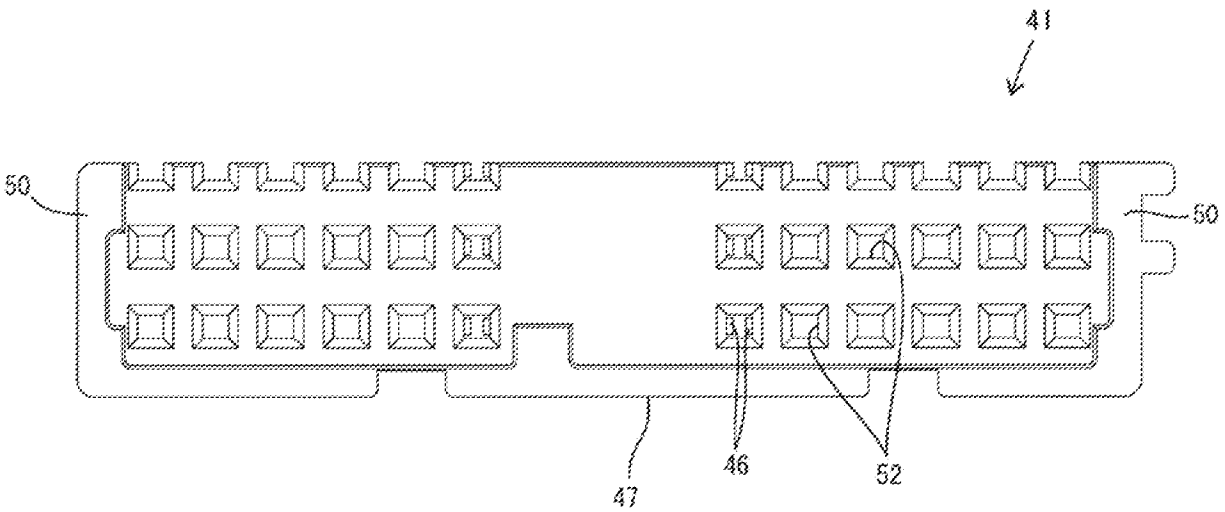
FIG. 16 is a back view of the short-circuit unit.
Figure 17:
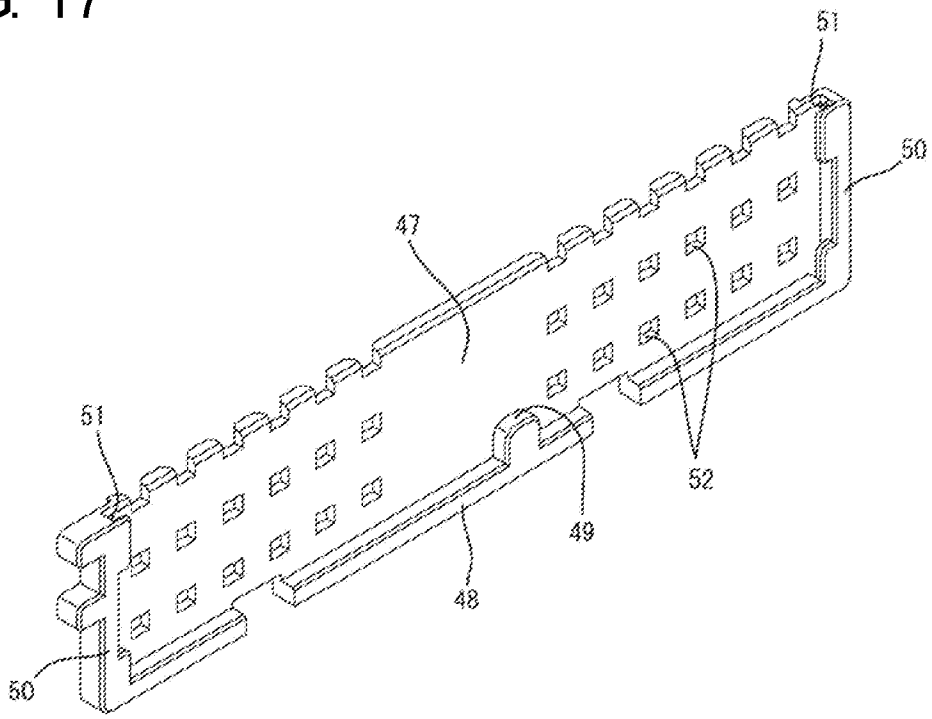
FIG. 17 is a perspective view of an insulating plate.
Figure 18:
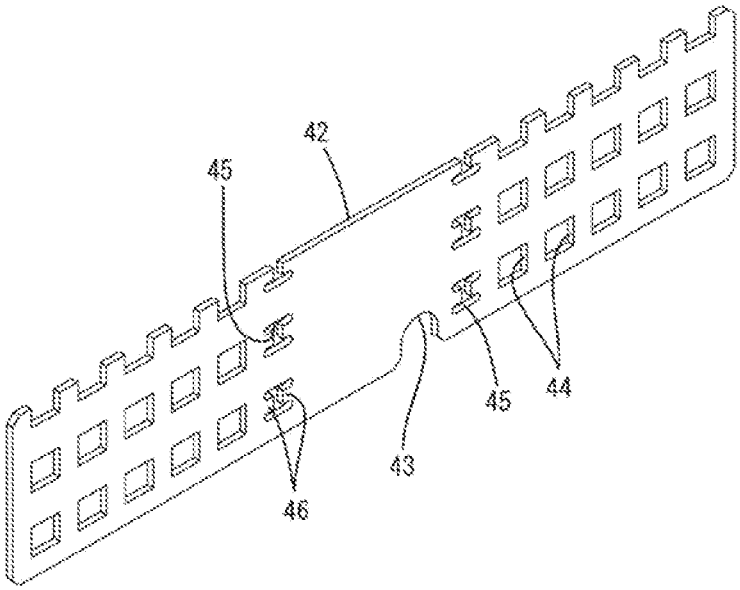
FIG. 18 is a perspective view of a short-circuit plate.
Figure 19:
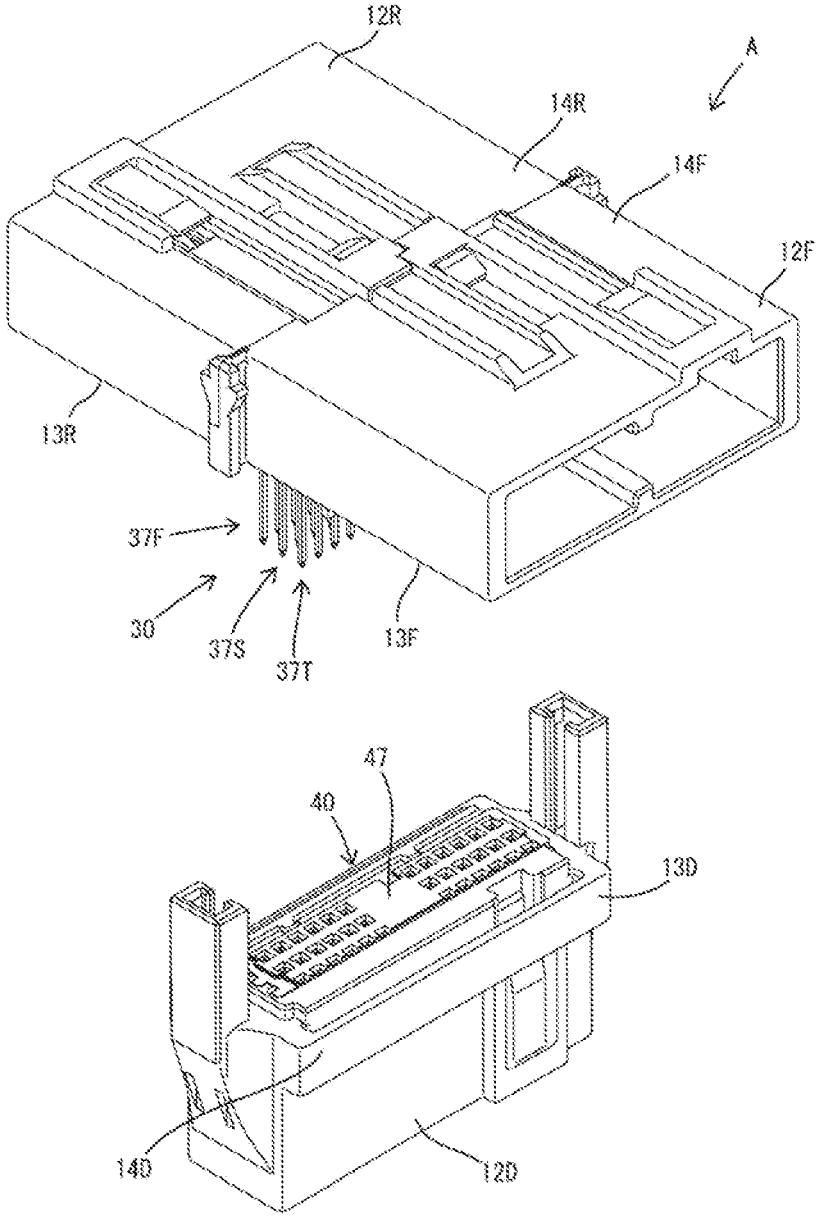
FIG. 19 is a perspective view showing the process of assembling the connector.

As shown in FIG. 13, the short-circuit module 40 is configured by laminating a plurality of short-circuit units 41. As shown in FIGS. 14 to 18, one short-circuit unit 41 is configured by assembling one short-circuit plate 42 (short-circuit member as claimed) made of metal and one insulating plate 47 made of synthetic resin.

The short-circuit plate 42 has a laterally long rectangular shape in a front view. An erroneous assembly preventing recess 43 is formed on one long side of the outer peripheral edge of the short-circuit plate 42. Non-contact holes 44 and conduction holes 45 are formed in the short-circuit plate 42 while being vertically and horizontally aligned to correspond to an arrangement of the tabs 39F, 39D, 39R. Each non-contact hole 44 has a square opening shape. Respective sides of the non-contact holes 44 are dimensioned to be larger than heights and widths of the tabs 39F, 39D and 39R.

The conduction hole 45 has a lying H-shaped opening and includes two resilient contact pieces 46 projecting inward to face each other. The resilient contact pieces 46 are resiliently deformable, and a minimum interval between the resilient contact pieces 46 in a free state where the resilient contact pieces 46 are not deformed resiliently is smaller than the widths of the tabs 39F, 39D, 39R. Thus, the tabs 39F, 39D, 39R inserted through the conduction holes 45 are in a conductive state with the short-circuit plate 42. These conduction holes 45 and non-contact holes 44 are appropriately arranged according to a combination of the tabs 39F, 39D, 39R to be shorted.

The insulating plate 47 has a laterally long rectangular front view shape one size larger than the short-circuit plate 42. A receiving rib 48 projects forward on one long side of the outer peripheral edge of the insulating plate 47. An erroneous assembly preventing projection 49 is formed on the front surface of the insulating plate 42 and projects from the receiving rib 48 to fit to the erroneous assembly preventing recess 43.

Supporting ribs 50 project forward from short sides of the outer peripheral edge of the insulating plate 47. The supporting ribs 50 are formed with mounting grooves 51 into which two short sides of the outer peripheral edge of the short-circuit plate 42 are fit. Guide holes 52 penetrate the insulating plate 47 in a plate thickness direction while being vertically and horizontally aligned to correspond to the non-contact holes 44 and the conduction holes 45. The guide holes 52 have square openings. One side of the guide hole 52 is shorter than one side of the non-contact hole 44 and is substantially equal to the height and width of the tab.

<Internal Structure of Connector A>

Inside the connector A, three short-circuit modules 40 are mounted in the body 11 while being individually accommodated in the accommodating portions 14F, 14D and 14R of the respective divided bodies 13F, 13D and 13R and are held in contact with the separation walls 15. The front surface of the short-circuit plate 42 faces the separation wall 15 and the back surface of the insulating plate 47 faces toward the opening side of the accommodating portion 14F, 14D, 14R. The terminal module 30 also is accommodated in the body 11.

The forward facing tabs 39F are passed through the guide holes 52, the non-contact holes 44 or the conduction holes 45 of the terminal module 40 and the positioning holes 16 of the separation wall 15 in the front divided body 13F. The rearward facing tabs 39R are passed through the guide holes 52, the non-contact holes 44 or the conduction holes 45 of the terminal module 40 and the positioning holes 16 of the separation wall 15 in the rear divided body 13R. The downward facing tabs 39D are passed through the guide holes 52, the non-contact holes 44 or the conduction holes 45 of the terminal module 40 and the positioning holes 16 of the separation wall 15 in the lower divided body 13D. Front parts of the forward facing tabs 39F are accommodated in the forward facing receptacle 12F, rear end parts of the rearward facing tabs 39R are accommodated in the rearward facing receptacle 12R and lower end parts of the downward facing tabs 39D are accommodated in the downward facing receptacle 12D.

The plurality forward facing tabs 39F that are passed through the conduction holes 45 of the respective short-circuit plates 42 are in a state capable of shorting to each other via the short-circuit plates 42. The forward facing tabs 39F that are passed through the non-contact holes 44 are not conductive with the short-circuit plates 42 formed with those non-contact holes 44. Since the forward facing tabs 39F are passed through the short-circuit plates 42 having different arrangements of the conduction holes 45, as many short-circuit patterns of the forward facing tabs 39F as the short-circuit plates 42 constituting one short-circuit module 40 can be set. The rearward facing tabs 39R also can be shorted to each other and the downward facing tabs 39D also can be shorted to each other in a plurality of patterns, similarly to the forward facing tabs 39F.

<Functions and Effects of Embodiment>

The connector A of this embodiment includes the terminal bases 38, the terminal fittings 37F, 37S and 37T each including three tabs 39F, 39D and 39R extending from the terminal bases 38 in mutually different directions, and the housing 10 having the body 11 for accommodating the terminal base portions 38 and the three receptacles 12F, 12D and 12R for individually surrounding the three types of tabs 39F, 39D and 39R. As shown in FIG. 4, end parts of the three conductive paths 61F, 61D and 61R of the wiring harness 60 are fit into the respective receptacles 12F, 12D and 12R. The conductive path 61F, 61D, 61R is composed of as many wires (not shown) as the terminal fittings 37F, 37S, 37T, and the respective wires are connected individually to the respective tabs 39F, 39D and 39R via female terminals (not shown).

The front conductive path 61F fit into the forward facing receptacle 12F and the rear conductive path 61R fit into the rearward facing receptacle 12R constitute a main line 52M extending in the front-rear direction via the forward facing tabs 39F, the terminal bases 38 and the rearward facing tabs 39R. The lower conductive path 61D fit into the downward facing receptacle 12D and the downward facing tabs 39D constitute a branch line 52S branched down substantially at a right angle from the main line M. The main line M and the branch line 52S constitute the wiring harness 60.

A part where the branch line 52S is branched from the main line M is constituted by the terminal bases 38 and base end parts of the three types of tabs 39F, 39D and 39R. Here, the base end parts of the respective tabs 39F, 39D and 39R are shaped linearly, and the base end parts (rear end parts) of the forward facing tabs 39F, the terminal bases 38 and the base end parts (front end parts) of the rearward facing tabs 39R constituting the main line M are connected linearly connected to one another. The downward facing tabs 39D constituting the branch line 52S are bent and branched at a small radius of curvature and substantially at a right angle from the terminal bases 38 (main line M). As just described, the terminal fittings 37F, 37S and 37T constituting the main line M and the branch line 52S are T-shaped in a side view, and the housing 10 for accommodating these terminal fittings 37F, 37S and 37T also is T-shaped in a side view. Thus, the wiring harness 60 (conductive paths 61F, 61D and 61R) can be routed in a narrow and bent space.

Further, since the three separation walls 15 partitioning between the body 11 and the three receptacles 12F, 12D and 12R are formed with the positioning holes 16 for positioning the tabs 39F, 39D and 39R, one terminal fitting 37F, 37S, 37T can be positioned stably by three positioning holes 16. Further, the housing 10 is formed by uniting the divided bodies 13F, 13D and 13R each integrating the accommodating portion 14F, 14D, 14R constituting the body 11 and one receptacle 12F, 12D, 12R. According to this configuration, the terminal bases 38 of the terminal fittings 37F, 37S and 37T can be accommodated in the body 11 by uniting the plurality of accommodating portions 14F, 14D and 14R.

Further, the connector A of this embodiment includes the temporary holding members 31. The holding grooves 34 are formed in the upper surfaces of the temporary holding members 31, and the through holes 36 vertically penetrate through the temporary holding members 31. The three tabs 39F, 39D and 39R extend forward, rearward and down from the terminal base 38, and the terminal fittings 37F, 37S, 37T are mounted in the temporary holding member 31 with the terminal bases 38 mounted in the holding grooves 34 and the downward facing tabs 39D extending down through the through holes 36. According to this configuration, the terminal fittings 37F, 37S, 37T can be positioned and held temporarily by one temporary holding member 31.

Further, since the temporary holding members 31 can be assembled in the vertically laminated state, the forward facing tabs 39F extending forward can be arranged vertically side by side and the rearward facing tabs 39R extending rearward can be arranged vertically side by side. Furthermore, the temporary holding members 31 vertically laminated are shaped identically and include the fitting projections 32 and the fitting recesses 33 to obtain such a positional relationship that the temporary holding members 31 are displaced from one another in the front-rear direction in the laminated state. According to this configuration, the downward facing tabs 39D extending downward can be arranged side by side in the front-rear direction without interfering with each other.

Further, an extending dimension of the downward facing tab 39D from the terminal base 38 is longer for the first terminal fitting 37F or second terminal fitting 37S mounted in the temporary holding member 31 on an upper side than for the second terminal fitting 37S or third terminal fitting 37T mounted in the temporary holding member 31 on a lower side. According to this configuration, the heights of the lower ends of the downward facing tabs 39D can be aligned.

Further, an extending dimension of the forward facing tab 39F from the terminal base 38 is longer for the second terminal fitting 37S or third terminal fitting 37T mounted in the temporary holding member 31 on a rear side than for the first terminal fitting 37F or second terminal fitting 37S mounted in the temporary holding member 31 on a front side in the laminated state. According to this configuration, the positions of the front ends (extending ends) of the forward facing tabs 39F can be aligned.

Further, an extending dimension of the rearward facing tab 39R from the terminal base 38 is longer for the first terminal fitting 37F or second terminal fitting 37S mounted in the temporary holding member 31 on the front side than for the second terminal fitting 37S or third terminal fitting 37T mounted in the temporary holding member 31 on the rear side in the laminated state. According to this configuration, the positions of the rear ends (extending ends) of the rearward facing tabs 39R can be aligned.

Further, the terminal fittings 37F, 37S and 37T are mounted in one housing 10, and the housing 10 is provided with the short-circuit plates 42 for shorting the terminal fittings 37F, 37S and 37T to each other by contacting the tabs 39F, 39D and 39R. Furthermore, the short-circuit plate 42 includes the conduction holes 45 for allowing the tabs 39F, 39D, 39R to pass therethrough in a contact state, and the non-contact holes 44 for allowing the tabs 39F, 39D, 39R to pass therethrough in a non-contact state. According to this configuration, only desired terminal fittings 37F, 37S, 37T can be shorted by appropriately setting an arrangement of the conductive holes 45 and the non-contact holes 44.

Other Embodiments

The invention is not limited to the above described embodiment. For example, the following embodiments also are included in the scope of the invention.

Although three tabs are formed in one terminal fitting in the above embodiment, four or more tabs may be formed in one terminal fitting.

Although the terminal fitting is T-shaped in a side view in the above embodiment, the terminal fitting may be K-shaped, X-shaped, Y-shaped or the like in a side view.

Although the housing is composed of three (as many as the types of the terminal fittings) divided bodies in the above embodiment, the number of the divided bodies constituting the housing may be two, four or more. In this case, the number of the types of the terminal fittings and the number of the divided bodies may be equal or may be different.

Although the terminal fittings are mounted in the housing while being temporarily held by the temporary holding members in the above embodiment, the terminal fittings may be directly mounted into the housing without using the temporary holding members.

Although three types of the terminal fittings having different extending dimensions of the tabs from the terminal base portions are mounted in one housing in the above embodiment, two, four or more types of terminal fittings may be mounted in one housing.

Although the plurality of terminal fittings are shorted to each other via the short-circuit plates in the above embodiment, the terminal fittings may not be shorted.

LIST OF REFERENCE SIGNS

A . . . connector
10 . . . housing
11 . . . body
12F . . . forward facing receptacle (receptacle)
12D . . . downward facing receptacle (receptacle)
12R . . . rearward facing receptacle (receptacle)
13F . . . front divided body (divided body)
13D . . . lower divided body (divided body)
13R . . . rear divided body (divided body)
15 . . . separation wall
16 . . . positioning hole
31 . . . temporary holding member
32 . . . fitting projection (fitting portion)
33 . . . fitting recess (fitting portion)
34 . . . holding groove
36 . . . through hole
37F . . . first terminal fitting (terminal fitting)
37S . . . second terminal fitting (terminal fitting)
37T . . . third terminal fitting (terminal fitting)
38 . . . terminal base
39F . . . forward facing tab (tab)
39D . . . downward facing tab (tab)
39R . . . rearward facing tab (tab)
42 . . . short-circuit plate (short-circuit member)
44 . . . non-contact hole
45 . . . conduction hole

The invention claimed is:

1. A connector, comprising:

a terminal fitting including a terminal base and three tabs extending from the terminal base in mutually different directions;

a housing including a body for accommodating the terminal base and three receptacles for individually surrounding the three tabs, three separation walls partitioning between the body and the three receptacles, the housing being formed by uniting a plurality of divided bodies each formed by integrating an accommodating portion of the body and one of the receptacles; and a temporary holding member formed with holding grooves in an upper surface and vertically penetrating through holes, wherein:

the three tabs extend forward, rearward and down from the terminal base; and the terminal fittings are mounted in the temporary holding member with the terminal bases mounted in the holding grooves and the downward extending tabs penetrating through the through holes.

2. The connector of claim 1, wherein:

the terminal fittings are mounted in one housing; and the housing is provided with a short-circuit member for shorting the terminal fittings to each other by contacting the tabs.

3. A connector of claim 1, comprising:

a terminal fitting including a terminal base and first, second and third tabs extending from the terminal base in mutually different directions;

a housing including a body for accommodating the terminal bases of all of the terminal fittings, the housing further including first, second and third receptacles, the first receptacle surrounding the first tabs, the second receptacle surrounding the second tabs, and the third receptacle surrounding the third tabs; and a temporary holding member formed with holding grooves in an upper surface and vertically penetrating through holes, wherein:

the first, second and third tabs respectively extend forward, rearward and down from the terminal base; and the terminal fittings are mounted in the temporary holding member with the terminal bases mounted in the holding grooves and the downward extending tabs penetrating through the through holes.

4. The connector of claim 3, wherein the housing is formed by respectively uniting first, second and third accommodating portions constituting the body and the first, second and third receptacles.

5. The connector of claim 1, wherein the terminal holding member comprises plural temporary holding members configured to be assembled while being vertically laminated.

6. The connector of claim 5, wherein the vertically laminated temporary holding members are shaped identically and include fittings to be fit to obtain such a positional relationship that the temporary holding members are displaced from each other in a front-rear direction in a laminated state.

7. The connector of claim 6, wherein an extending dimension of the forward extending tab from the terminal base is longer for the terminal fitting mounted in the temporary holding member on a rear side than for the terminal fitting mounted in the temporary holding member on a front side.

8. The connector of claim 6, wherein an extending dimension of the downward extending tab from the terminal base is longer for the terminal fitting mounted in the temporary holding member on an upper side than for the terminal fitting mounted in the temporary holding member on a lower side.

9. The connector of claim 8, wherein an extending dimension of the forward extending tab from the terminal base is longer for the terminal fitting mounted in the temporary holding member on a rear side than for the terminal fitting mounted in the temporary holding member on a front side.

10. The connector of claim 9, wherein an extending dimension of the rearward extending tab from the terminal base is longer for the terminal fitting mounted in the temporary holding member on a front side than for the terminal fitting mounted in the temporary holding member on a rear side.

11. The connector of claim 6, wherein an extending dimension of the rearward extending tab from the terminal base is longer for the terminal fitting mounted in the temporary holding member on a front side than for the terminal fitting mounted in the temporary holding member on a rear side.

12. The connector of claim 11, wherein:

the terminal fittings are mounted in one housing; and the housing is provided with a short-circuit member for shorting the terminal fittings to each other by contacting the tabs.

13. The connector of claim 12, wherein the short-circuit member includes conduction holes for allowing the tabs to pass therethrough in a contact state and non-contact holes for allowing the tabs to pass therethrough in a non-contact state.

14. A connector comprising:

terminal fittings, each of the terminal fittings including a terminal base and first second and third tabs extending from the terminal base in mutually different directions; and a housing including a body for accommodating the terminal bases of all of the terminal fittings, the housing further including first, second and third receptacles, the first receptacle surrounding the first tabs, the second receptacle surrounding the second tabs, and the third receptacle surrounding the third tabs;

a short-circuit member provided in the housing for shorting the terminal fittings to each other by contacting the tabs, the short-circuit member including conduction holes for allowing the tabs to pass therethrough in a contact state and non-contact holes for allowing the tabs to pass therethrough in a non-contact state.

15. The connector of claim 14, wherein the housing further has first, second and third separation walls partitioning respectively between the body and the first, second and third receptacles, positioning holes formed in the separation walls for positioning the tabs.

16. The connector of claim 15, wherein the housing is formed by uniting a plurality of divided bodies each formed by integrating an accommodating portion constituting the body and one of the receptacles.

* * * * *